United States Patent [19]

Bull

[11] Patent Number: 4,620,473

[45] Date of Patent: Nov. 4, 1986

[54] MECHANISM FOR TIMING STRAND MOVEMENT RELATIVE TO ROTATION OF SPOOL HOLDERS OR CARRIERS FOR STRAND SUPPLY SPOOLS OR BOBBINS

[76] Inventor: Jeffrey F. Bull, 1270 Hazelwood Ave., Akron, Ohio 44305

[21] Appl. No.: 766,493

[22] Filed: Aug. 19, 1985

[51] Int. Cl.[4] ..... D04C 3/06; D04C 3/24; D04C 3/38; D04C 3/42

[52] U.S. Cl. ..... 87/48; 87/29; 87/33; 87/37; 87/44

[58] Field of Search ..... 87/29, 30, 32–34, 87/14–17, 44–48

[56] References Cited

U.S. PATENT DOCUMENTS

| | | | |
|---|---|---|---|
| 1,955,206 | 4/1934 | Standish | 87/47 |
| 2,464,899 | 3/1949 | Sokol | 87/48 |
| 3,362,283 | 1/1968 | Dergachen et al. | 87/44 X |
| 3,756,117 | 9/1973 | DeYoung | 87/29 |
| 3,892,161 | 7/1975 | Sokol | 87/29 |
| 4,034,642 | 7/1977 | Iannucci et al. | 87/48 |
| 4,034,643 | 7/1977 | Iannucci et al. | 87/48 |
| 4,130,046 | 12/1978 | Sokol | 87/48 |
| 4,275,638 | 6/1981 | DeYoung | 87/29 X |
| 4,372,191 | 2/1983 | Iannucci et al. | 87/48 |
| 4,380,949 | 4/1983 | Betta | 87/48 |

*Primary Examiner*—John Petrakes

*Attorney, Agent, or Firm*—Mack D. Cook, II

[57] ABSTRACT

A mechanism for timing strand movement relative to rotation of holders or carriers for strand supply spools or bobbins, being rotated in opposite directions by the drive mechanism of a braiding machine. The drive mechanism is mounted around a stationary shaft extending from a frame member. The mechanism includes an adjustable actuator means carried by the frame member radially of the stationary shaft and housng a selectively rotatable control shaft carrying a first sprocket. A second sprocket connected to the first sprocket by a chain means is connected to a journal sleeve around the stationary shaft. The journal sleeve carries a circular control element. The control element carries either a series of passive deflector cam plates for yarn strands or a cam track for a series of positive wire strand guiding mechanisms. There is also an improved drive mechanism for a braiding machine having a rotating table for carrying a set of outer spool holders.

4 Claims, 7 Drawing Figures

MECHANISM FOR TIMING STRAND MOVEMENT RELATIVE TO ROTATION OF SPOOL HOLDERS OR CARRIERS FOR STRAND SUPPLY SPOOLS OR BOBBINS

BACKGROUND OF THE INVENTION

The invention relates to an improved strand fabricating machine.

More specifically, the invention relates to an improved mechanism for timing strand movement relative to rotation of spool holders or carriers for strand supply spools or bobbins being rotated in opposite directions by the drive mechanism of a braiding machine.

U.S. Pat. No. 4,535,672, 8/1985, Bull et al, Apparatus For Mounting Components For Rotation Of Carriers For Strand Supply Bobbins And For Timing Strand Movement Relative To Rotation, discloses that "[a]nother problem existent with prior art braiding machines . . . carrying a set or series of spools or bobbins, has been providing for selective adjustment of the timing of movement of strand material from a set of rear or lower bobbins, along the central axis of the braiding machine, relative to contra-rotation of a set of front or upper bobbin carriers. The passage of the rear strands between any two carriers for the front bobbins, must occur within the dimensions of a relatively small 'window'. The timing of rear strand passage through the 'window' between the contra-rotating front bobbin carriers should be adjustable. An efficient braiding machine should be able to run with strand materials of varied composition or different outer diameters. A limited timing adjustment will optimize the operating conditions for any one particular form of strand material."

Until the invention disclosed and claimed in U.S. Pat. No. 4,535,672, the "[p]rior art braiding machines known to the inventors have had no easy means of changing timing between rear strand movement and the position of a passing front strand carrier. Timing changes have required disassembly of portions of the braiding machine and reassembly in different positions. Also, timing could never be changed while the braiding machine was operating."

In U.S. Pat. No. 4,535,672, the solution to the timing change problem is provided by an arcuately adjustable means projecting into a frame stanchion medial lattice opening for the support of the rear end of a drive torque tube carrying a control element (328). As generally described in U.S. Pat. No. 4,535,672, a "[c]ontrol element 328, positioned around the central axis stationary shaft 123 and behind the rear side of the first table 121 for carrying and positioning a cam track (329) radially inwardly of the rear carriers 20R, is adjustably rotated for use with a set of mechanisms (326) for guiding strands from bobbins on the rear carriers 20R through an arc segment relative to the central axis of the braiding machine 120, over and around moving strands from bobbins on the front carriers 20F . . . "

As further described in U.S. Pat. No. 4,535,672, "[t]he mounting assembly 125 further has an arcuately adjustable means projecting into the frame stanchion medial lattice opening 135 for support of the rearwardly projecting end or base 139 of the drive torque tube 136 and to adjustably position the control element 328 radially of the central axis stationary shaft 123 for timing movement of strands from a set of rear carriers 20R along the central axis of the braiding machine 120 relative to contra-rotation of the moving strands from a set of front carriers 20F.

As shown, a pitman hanger indicated at 140 interconnects the stationary shaft end 130 and the drive torque tube end 139. The upper end of a pitman hanger 140 has a tightenable clamp ring 141 for securely engaging the shaft end 130. The medial portion of a pitman hanger 140 has a tightenable clamp yoke 142 for securely engaging the tube end 139. The lower end of a pitman hanger 140 has a downwardly projecting lever 143. The pitman hanger lever 143 is selectively engaged for limited adjustable arcuate movement around the central axis of the braiding machine 120 by an adjustment means on the frame stanchion shelf flange 134. As shown, the adjustment means for the pitman hanger lever 143 may be opposed adjustment bolts 144 carried by opposed bolt mounting flanges 145 mounted on the frame stanchion shelf flange 134."

The inventor has recently become involved in a redesign and improvement of a yarn braiding machine of the design and construction disclosed in U.S. Pat. No. 3,756,117, 9/1973, DeYoung. This earlier braiding machine has a set of deflector cam plates with contoured edge surfaces to guide movement of strands from a set of outer spools relative to, over and under, moving strands from a set of inner spools. In this earlier machine, timing changes were made only by disassembly and reassembly of various components.

The inventor has now found that it is possible to provide for the braiding machine of U.S. Pat. No. 3,756,117 a mechanism for timing movement of strands from outer spool holders relative to rotation of inner spool holders, which is precise and effective and which does not require disassembly and reassembly of various components.

The inventor has further found that the braiding machine of U.S. Pat. No. 4,535,672, can be provided with a mechanism for timing movement of strands from rear bobbin carriers relative to rotation from bobbin carriers which is even more precise and effective than before.

The inventor has further found that the braiding machine of U.S. Pat. No. 3,756,117 may be provided with an improved drive mechanism for rotating a set of outer spool holders in one circular direction, and, through a set of planet gears driven by a stationary sun gear, rotate a set of inner spool holders in the opposite direction.

SUMMARY OF THE INVENTION

It is an object of the invention to provide an improved strand fabricating machine.

It is a further object of the invention to provide an improved mechanism for timing strand movement relative to rotation of spool holders or carriers for strand supply spools or bobbins being rotated in opposite directions by the drive mechanism of a braiding machine.

These and other objects of the invention, as well as the advantages thereof, will become apparent in view of the drawings and detailed description.

A mechanism according to the invention is used for timing strand movement relative to rotation of spool holders or carriers for strand supply spools or bobbins, being rotated in opposite directions by the drive mechanism of a braiding machine. The drive mechanism is mounted around a central axis stationary shaft extending laterally from a base supported frame member.

A strand movement timing mechanism according to the invention will include an adjustable control actuator means carried by the frame member and positioned radially of the central axis stationary shaft and housing a rotatable control shaft. A first sprocket is carried on the actuator means control shaft. A journal sleeve is positioned around the central axis stationary shaft. A second sprocket is aligned with the first sprocket coaxially around the journal sleeve and connected thereto. A first chain means connects the first sprocket with the second sprocket whereby rotation of the actuator control shaft will rotate the second sprocket and the journal sleeve relative to the central axis stationary shaft. A circular control element is positioned coaxially around the journal sleeve and connected thereto.

The strand movement timing mechanism according to the invention may be used on a braiding machine having a set of deflector cam plates with contoured edge surfaces to guide movement of strands from a set of outer spools relative to, over and under, moving strands from a set of inner spools. In this embodiment, for example, a yarn braiding machine of the design and construction disclosed in U.S. Pat. No. 3,756,117, 9/1973, DeYoung, the circular control element of the strand movement timing mechanism projects radially of the central axis stationary shaft and terminates in an edge positioned adjacent an outer set of spool holders. The strand deflector cam plates are positioned symmetrically around the control element edge and connected thereto.

The strand movement timing mechanism according to the invention may also be used on a wire braiding machine of the design and construction disclosed in U.S. Pat. No. 4,535,674, 8/1985, Bull et al. This braiding machine has rear and front bobbins on sets of rear and front carriers being rotated in opposite directions by a drive mechanism. The drive mechanism is mounted around a central axis stationary shaft extending laterally from a base supported frame member. The set of rear carriers is mounted on the rear side of a first table. The strands from the rear bobbins pass through a set of peripheral slots in the first table which are radially arcuate for movement of a set of strands through an arc segment relative to the axis of the stationary shaft. A second table is in front of the first table. The set of front carriers is mounted on and driven around the front side of the first table by rotation of the second table. The central axis stationary shaft rotatably mounts the first and second tables thereon.

This wire braiding machine further has a set of mechanisms carried on the rear side of the first table for guiding a set of strands from the rear bobbins prior to movement thereof into the first table radially arcuate peripheral slots. A variable radius cam tack is positioned behind the rear side of the first table and radially inwardly of the set of rear carriers. The cam track actuates and controls the set of rear strand guide mechanisms by rotation of the first table.

In this embodiment, the circular control element of the strand movement timing mechanism is positioned coaxially around the journal sleeve and connected thereto behind the rear side of the first table. The variable radius cam track is carried by and adjustably positioned by the circular control element.

The invention also provides an improved drive mechanism for a braiding machine having sets of outer and inner holders for strand supply spools being rotated in opposite directions by the drive mechanism which is mounted around a central axis stationary shaft extending from a frame member. The drive mechanism is driven by a power input shaft extending from the frame member and includes a stationary sun gear and a rotating table mounting the set of outer spool holders and rotatably carrying a set of inner spool holders. The machine has a journal sleeve for a braid control mechanism adjustably fixed in position around the stationary shaft. The drive mechanism further has a journal hub rotatably mounted around the stationary shaft and carrying the journal sleeve. A third sprocket is positioned around the journal hub and connected thereto. A fourth sprocket is aligned with the third sprocket and carried on the power input shaft. A second chain means connects the third sprocket with the fourth sprocket. The rotating table is positioned around the journal hub and connected thereto so that rotation of the fourth sprocket by the power input shaft will rotate the set of outer spool holders in one circular direction, and, through a sun gear, rotate the set of inner spool holders in the opposite direction.

IN THE DRAWINGS

DETAILED DESCRIPTION OF THE INVENTION

Figure 1:
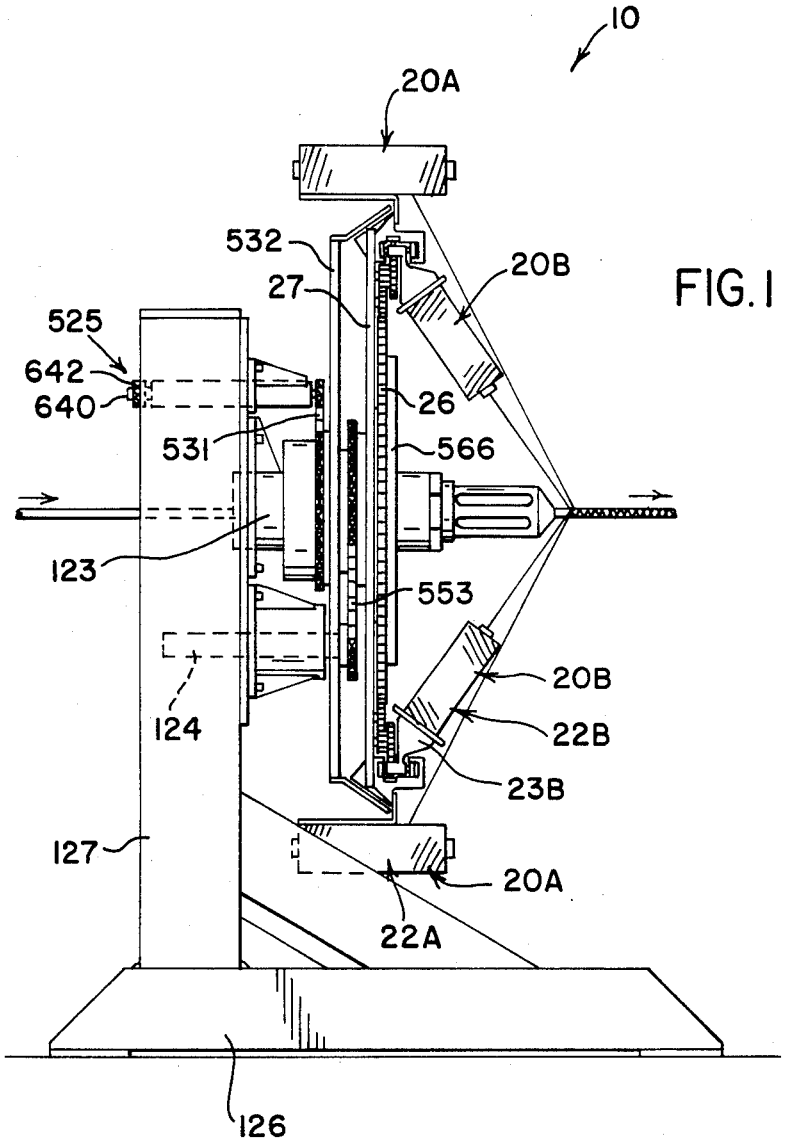
FIG. 1 is a side view of a yarn braiding machine with components according to the invention.
Figure 2:
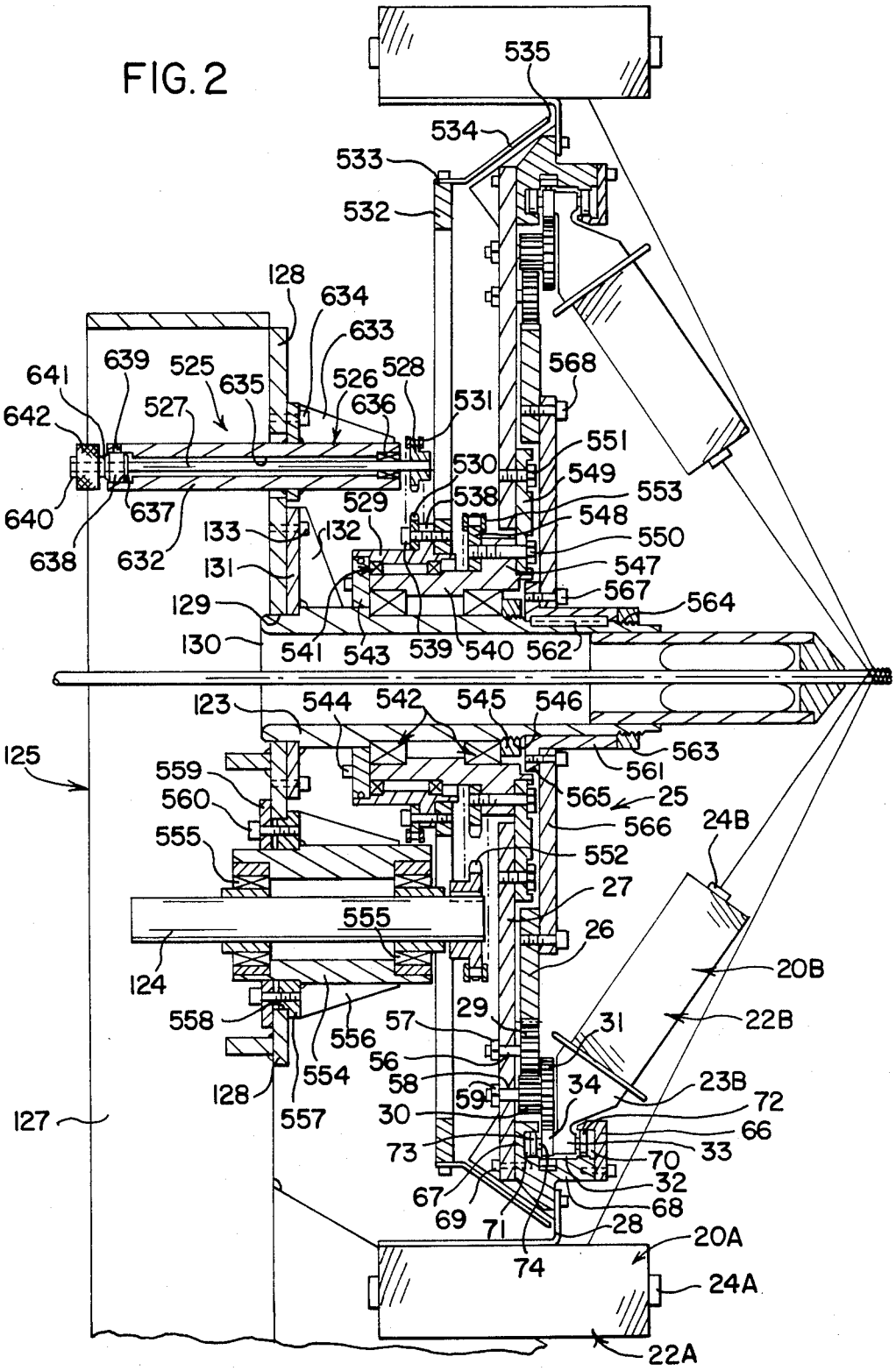
FIG. 2 is an enlarged section of the braiding machine of FIG. 1.
Figure 3:
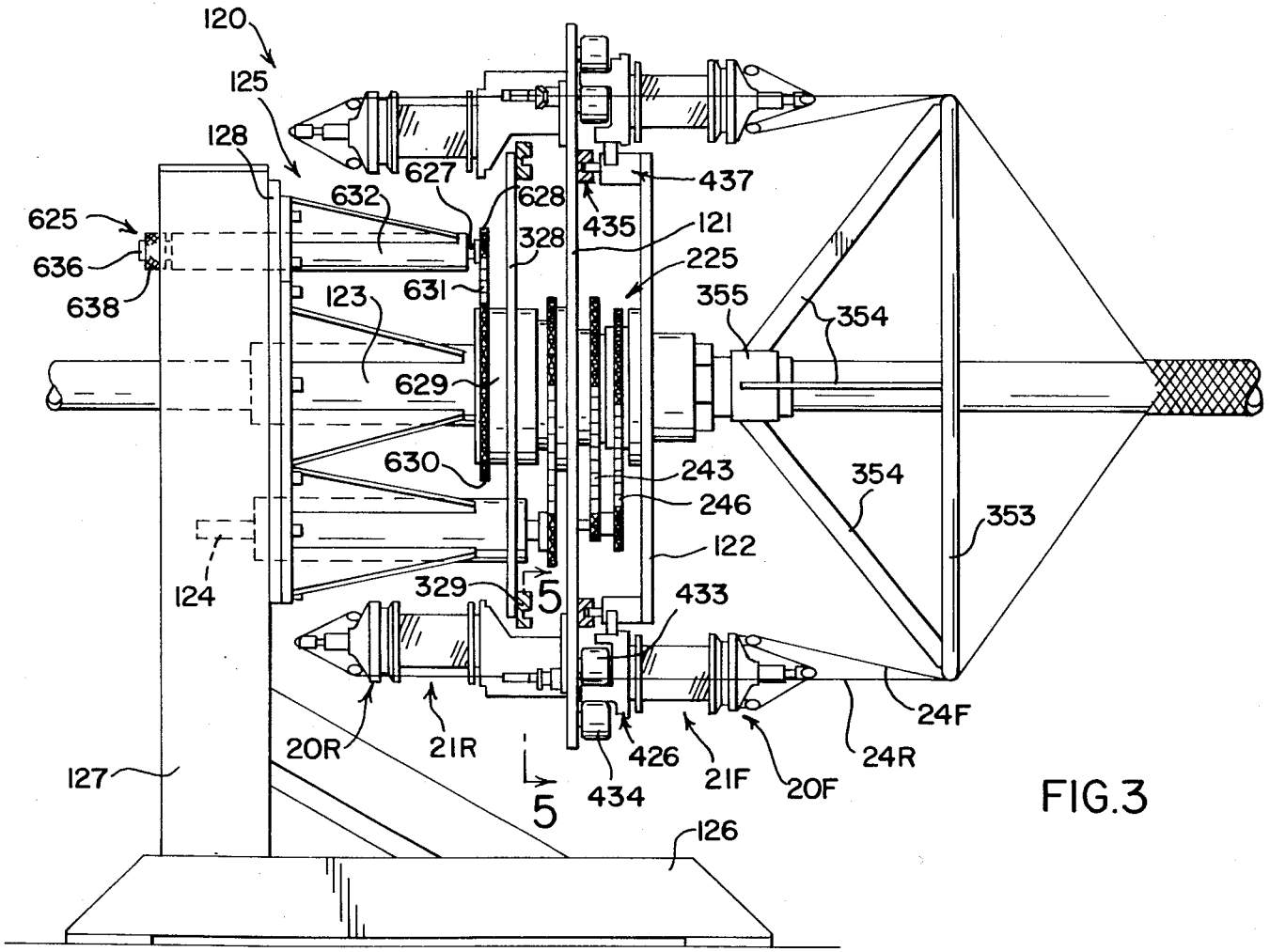
FIG. 3 is side view of a wire braiding machine with a component according to the invention.
Figure 4:
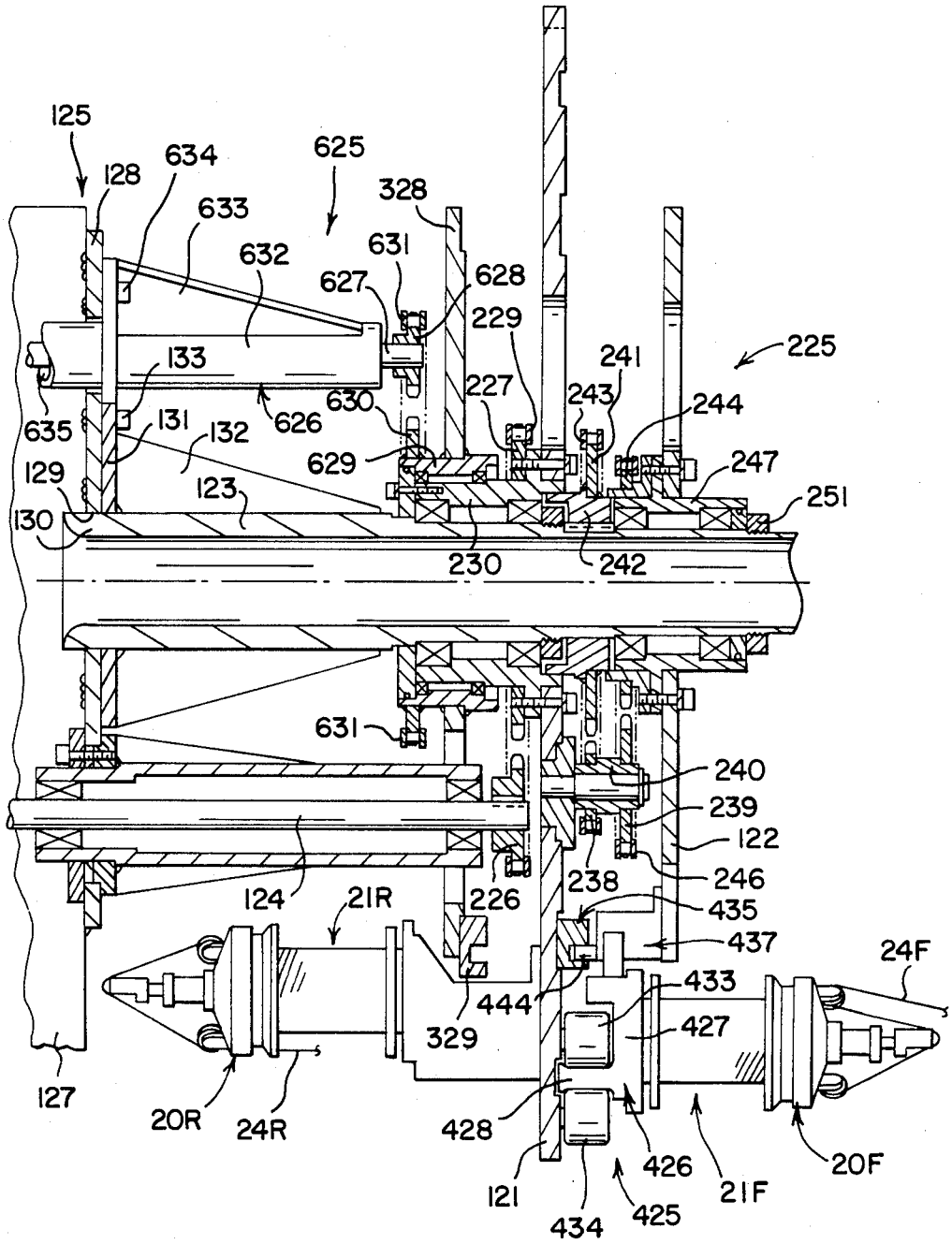
FIG. 4 is an enlarged section of the braiding machine of FIG. 3.
Figure 5:
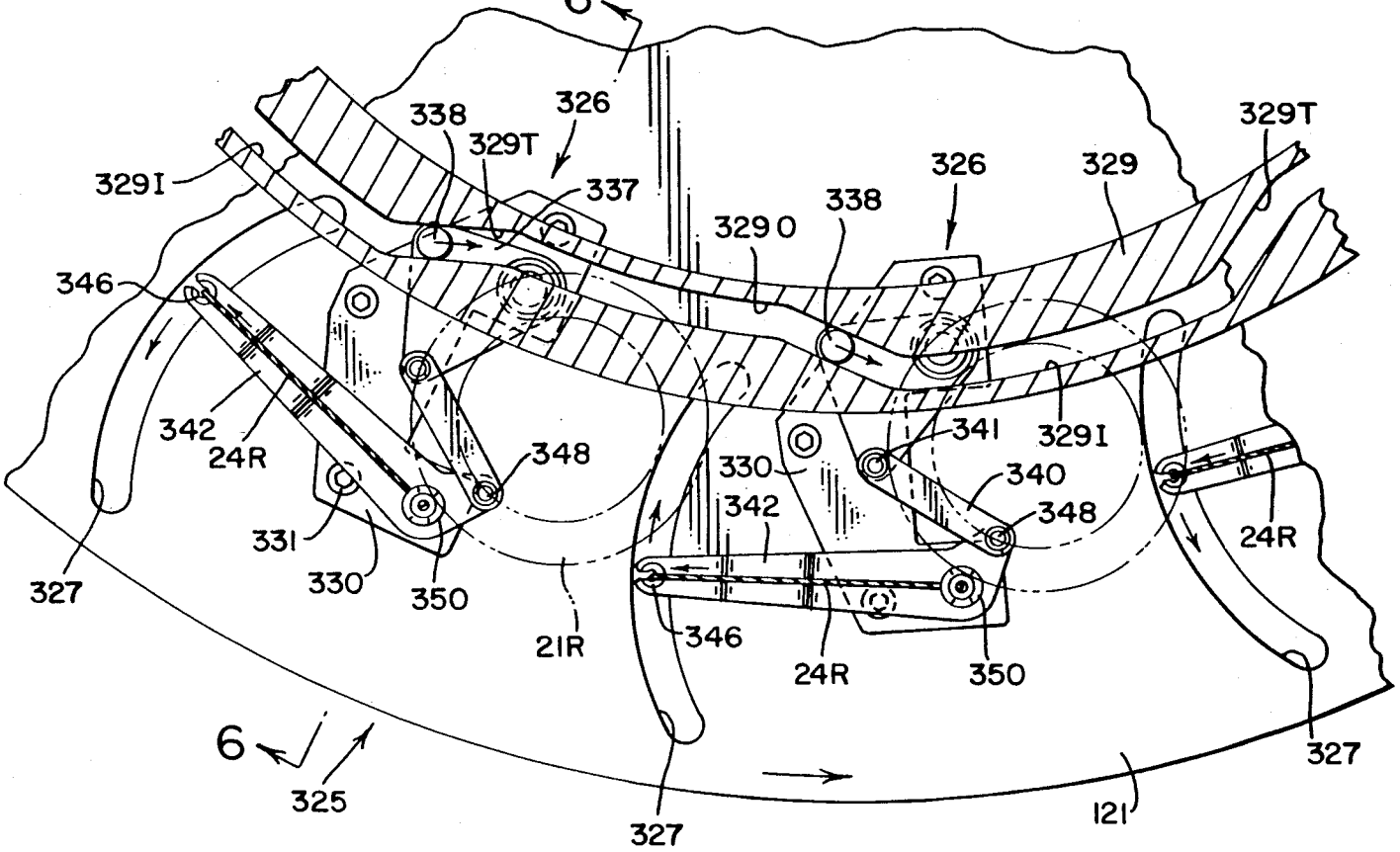
FIG. 5 is an enlarged fragmentary rear section, looking toward the front of the braiding machine, taken substantially as indicated on line 5—5 of FIG. 3.
Figure 6:
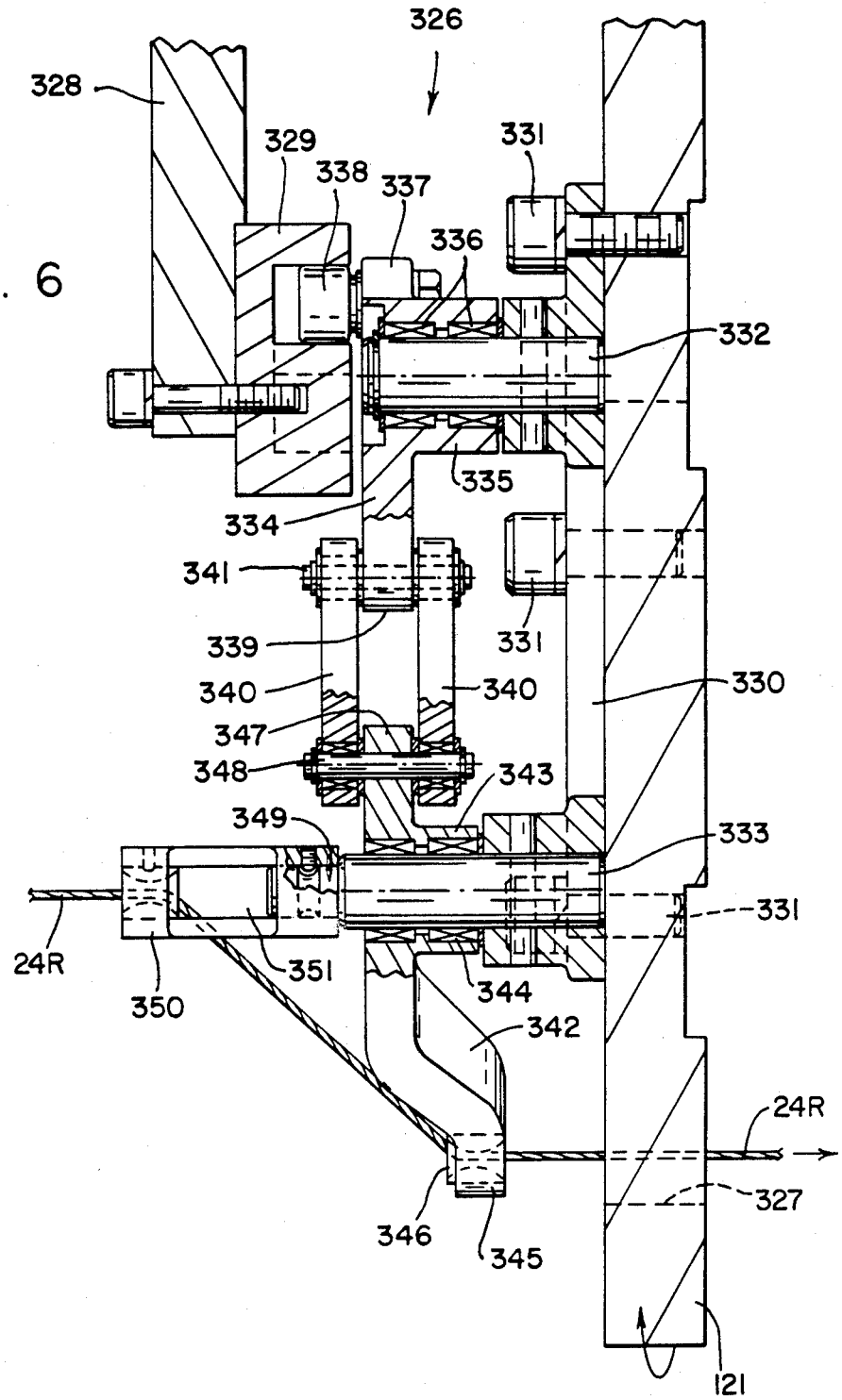
FIG. 6 is a side view, in section, taken substantially as indicated on line 6—6 of FIG. 5.
Figure 7:
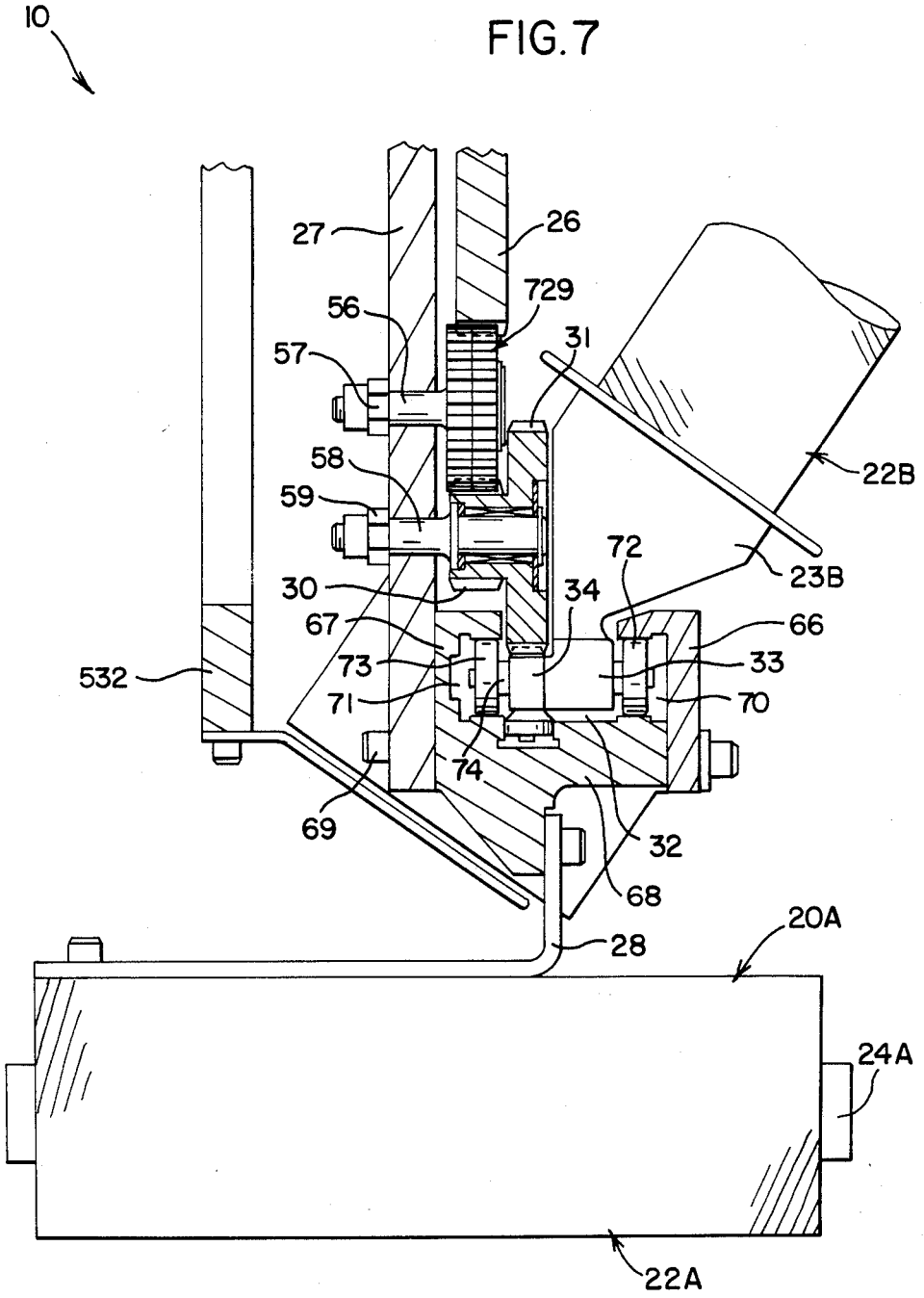
FIG. 7 is an enlarged fragmentary section of the braiding machine of FIG. 1.

Referring to FIGS. 1,2 and 7, a horizontal yarn braiding machine, embodying the present invention, is referred to generally by the numeral 10. The braiding machine 10 will have a set of outer spools 20A and a set of inner spools 20B. The spools 20 are on sets of outer spool holders 22A and inner spool holders 22B which are rotated in opposite directions by a drive mechanism referred to generally by the numeral 25. The spool drive mechanism 25 has elements, numbered within the sequence 26 through 74, which are equivalent to like numbered elements disclosed in U.S. Pat. No. 3,756,117, 9/1973, DeYoung. The braiding machine 10 has a central axis stationary shaft 123 and a drive mechanism power input shaft 124, as disclosed in U.S. Pat. No. 4,535,672, 8/1985, Bull and Winiasz. The braiding machine 10 has an assembly referred to generally by the numeral 125 for mounting and powering the spool drive mechanism 25. The assembly 125 has elements, numbered in the sequence 126 through 133, which are equivalent to like numbered elements disclosed in U.S. Pat. No. 4,535,672.

An outer spool holder 22A has a base (not shown). An inner spool holder 22B has a base 23B. The spool holder bases house therein suitable mechanisms (not shown) for controlling rotation of spool spindles 24A and 24B. The spool holders 22A and 22B also have suitable mechanisms (not shown) for strand tension-controlling and actuation of spool release. For such further details as are necessary to understand the operation of these mechanisms, reference may be made to U.S. Pat. No. 3,756,533, 9/1973, DeYoung.

A spool drive mechanism 25 includes a stationary sun gear 26 and a rotatable support plate 27 mounted in axial alignment around the central axis of the braiding machine 10. The support plate 27 is powered and carries a first set of base holders 28 for mounting of the outer set of spool holders 22A. The support plate 27 also carries sets of rotatably mounted and meshing first planet gears 29 and second planet gears 30. Each planet gear 29 meshes with the sun gear 26. Each planet gear 30 is axially coupled to a third planet gear 31.

The support plate 27 also has a circular guideway 32 for the support of the second set of base holders 33 for mounting of the inner set of spool holders 22B. Each base holder 33 carries a radially inwardly facing gear segment 34 for meshing with the planet gear 31.

Each planet gear 29 is bearing mounted on a stud 56 projecting from the support plate 27 and attached thereto as by fastening means 57. Each planet gear 30 is bearing mounted on a stud 58 projecting from the support plate 27 and attached thereto as by fastening means 59. The distance between the studs 56 and 58 is less than the length of a gear segment 34. That is, the effective length of each gear segment 34 is greater than the distance between axes of adjacent third planet gears 31.

The guideway 32 for the baseholders 33 for the inner spool holders 22B is formed by sets of opposed arcuate plates 66 and 67 separated by a spacer block 68 and attached to the support plate 27 as by fastening means 69. Each plate 66 and 67 has opposed and aligned channels 70 and 71. Each base holder 33 has two sets of rollers 72 and 73 carried on a shaft 74 for seating in and movement along the channels 70 and 71.

Rotation of the support plate 27 in relation to the sun gear 26 will move the base holders 28, the spool holders 22A and the outer spools 20A in one circular direction around the central axis of the braiding machine 10. Concurrently, each set of planet gears 29, 30 and 31 will transmit power to the arcuate gear segments 34 to move the base holders 33, the spool holders 22B and the inner spools 20B in the opposite circular direction.

The braiding machine 10 has a central axis stationary shaft 123 for fixed mounting of the sun gear 26 and for rotatably mounting of the support plate 27 carrying the outer bobbins 20A. A drive mechanism power input shaft 124 extends parallel to the stationary shaft 123 toward the support plate 27.

The mounting assembly 125 has a frame base 126 carrying a vertically extending frame member or stanchion 127. The frame stanchion 127 has an integral face plate 128 with an upper bore 129 for positioning the base 130 of the stationary shaft 123. A shaft support plate 131, having a series of lateral webs 132 securely connected to the stationary shaft 123, is detachably connected to the stanchion face plate 128 coaxially around the face plate upper bore 129, as by fastening bolts 133.

The mechanism for timing movement of strands from a set of outer spools 20A relative to rotation of spool holders 22B for a set of inner spools 20B, is referred to generally by the numeral 525. The mechanism 525 includes an adjustable control actuator means indicated at 526, carried by the frame member 127 and positioned radially of the central axis stationary shaft 123. The control actuator means 526 houses a rotatable control shaft 527. A first sprocket 528 is carried on the actuator control shaft 527. A journal sleeve, indicated at 529, is positioned around the central axis stationary shaft 123. A second sprocket 530 is aligned with the first sprocket 528 and positioned coaxially around the journal sleeve 529 and connected thereto. A first chain means 531 connects the first sprocket 528 with the second sprocket 530 so that incremental rotation of the actuator control shaft 527 will selectively position the second sprocket 530 and the journal sleeve 529 relative to the central axis stationary shaft 123.

A circular control element, indicated at 532, is positioned coaxially around the journal sleeve 529 and connected thereto. The control element 532 projects radially of the central axis stationary shaft 123 and terminates in an edge 533 positioned adjacent the set of outer spools 20A.

A set of projecting strand deflector cam plates, indicated at 534, are positioned symmetrically around the control element edge 533 and connected thereto. The contoured edge surfaces 535 of the cam plates 534 guide the movement of strands from the set of outer spools 20A relative to, over and under, moving strands from the set of inner spools 20B. The contour and effective length of the control cam plate surfaces 535, relative to the distance between adjacent inner spool holders 22B, determines the braid ratio (e.g. 1 outer strand: 2 inner strands). However, a fine and precise adjustment of the position of the cam plates 534 relative to the spacing between inner spool holders 22B will enable the user of the braiding machine 10 to compensate or allow for variation in strand movement attributable to yarn diameter or by friction caused by yarn movement over the control cam plate surfaces 535.

The braid control mechanism journal sleeve 529 has an annular shoulder flange 538 for secure connection thereto of the second sprocket 530 and the cam plate control element 532, as by fastening bolts 539.

The journal sleeve 529, adjustably fixed in position relative to the central axis stationary shaft 123, is carried by a journal hub, indicated at 540, freely rotatable around the stationary shaft 123. An outer bearing assembly, indicated at 541, provides for rotation of the journal hub 540 relative to a fixed journal sleeve 529. An outer bearing assembly, indicated at 542, provides for rotation of the journal hub 540 relative to the stationary shaft 123. The rearward end of the sleeve 529 mounted on the bearings 541 and the rearward end of the hub 540 mounted on the bearings 542, are secured by an annular end retainer 543 attached to the hub 540, as by fastening bolts 544. The forward end of the journal hub 540 is secured around the stationary shaft 123 by a bearing nut 545 having internal threads for mating engagement with external threads 546 on the stationary shaft 123.

The journal hub 540 is also a component of the spool drive mechanism 25. Forward of the journal sleeve 529, the hub 540 has an annular shoulder flange 547 for secure connection thereto of a third or driven sprocket 548 and a table mounting plate 549, as by fastening bolts 550. The mounting plate 549 carries and is securely connected to the rotating table 27 of the drive mechanism 25, as by fastening bolts 551. A fourth or drive sprocket 552, aligned with the third sprocket 548 and connected therewith by a second chain means 553, is securely mounted on the forward end of the power input shaft 24.

The power input shaft 124 for the spool drive mechanism 25 is rotatably mounted within a housing tube 554 by a bearing assembly, indicated at 555. A series of lateral webs 556 and a housing tube support plate 557 are securely connected to the housing tube 554. The rearward end of the housing tube 554 projects through a lower bore 558 in the stanchion face plate 128. The shaft support plate 557 is detachably connected to the stanchion plate 128 coaxially around the face plate lower bore 558, as by a mounting ring 559 and fastening bolts 560.

The power input shaft 124 is connected to a suitable power source (not shown) to rotate the table 27 of the drive mechanism 25 and the outer spool holders 22A in one circular direction around the central axis of the braiding machine 10.

Forward of the bearing nut 545 securing the rotating journal hub 540 around the central axis stationary shaft 123, the spool drive mechanism 25 includes a hub member 561 for mounting of the stationary sun gear 26. The hub 561 is fitted coaxially around and coupled to the stationary shaft 123, as by a key 562. The forward end of the hub 561 is secured around the stationary shaft 123 by a bearing nut 563 having internal threads for mating with external threads 564 on the stationary shaft 123. The hub 561 has an annular shoulder flange 565 for secure connection thereto of a sun gear mounting plate 566, as by fastening bolts 567. The mounting plate 566 carries and is securely connected to the stationary sun gear 26 of the drive mechanism 25, as by fastening bolts 567. During rotation of the table 27 of the drive mechanism 25 by the power input shaft 124, in one direction, the set of planet gears 29, 30 and 31 driven by the stationary sun gear 26, will rotate the inner spool holders 22B in the opposite circular direction around the central axis of the braiding machine 10.

Referring to FIGS. 3-6, a horizontal wire braiding machine, embodying the present invention, is referred to generally by the numeral 120. The braiding machine 120 will have a set of rear carriers 20R for a strand supply bobbin mounted on the rear side of a first table 121 for rotation in one direction. The braiding machine 120 will further have a set of front carriers 20F for a strand supply bobbin movable around the front side of the first table 121 for rotation by a second table 122 in the opposite direction. A stationary shaft 123 on the central axis of the braiding machine rotatably mounts the first table 121 and second table 122 thereon. A drive mechanism power input shaft 124 extends parallel to the stationary shaft 123 and toward the rear side of the first table 121.

A carrier 20 for a supply bobbin particularly suited for use on a braiding machine 120 may be as disclosed in U.S. Pat. No. 4,529,147, 7/1985, Bull, et al, Carrier for A Strand Supply Bobbin. Reference is made to said patent for such further details as may be required to more fully understand the nature of the invention. A moving length of strand material from a rear carrier 20R is indicated at 24R. A moving length of strand material from a front carrier 20F is indicated at 24F.

An assembly for mounting of the cental axis stationary shaft 123 and radial positioning of the power input shaft 124, is referred to generally by the numeral 125. A mounting for the stationary shaft 123 and the power input shaft 124 is shown only by chain lines. A mounting assembly 125 particularly suited for use on a braiding machine 120 may be as disclosed in U.S. Pat. No. 4,535,672, 8/1985, Bull et al, Apparatus For Mounting Of Components For Rotation Of Carriers For A Strand Supply Bobbin And For Timing Strand Movement Relative To Rotation.

The mounting assembly 125 has a frame base 126 carrying a vertically extending frame member or stanchion 127. The frame stanchion 127 has an integral face plate 128 with an upper bore 129 for positioning the base 130 of the stationary shaft 123. A shaft support plate 131, having a series of lateral webs 132 securely connected to the stationary shaft 123, is detachably connected to the stanchion face plate 128 coaxially around the face plate upper bore 129, as by fastening bolts 133.

A drive mechanism for selectively rotating the first table 121 and the second table 122 in opposite directions around the stationary shaft 123, in response to rotation of the power input shaft 124, is referred to generally by the numeral 225. A drive mechanism 225 particularly suited for use on a braiding machine 120 may be as disclosed in U.S. Pat. No. 4,535,673, 8/1985, Winiasz, Apparatus For Rotation Of Carriers For A Strand Supply Bobbin.

The table drive mechanism 225 has a first sprocket 226 mounted on the forward end of the power input shaft 124 and behind the rear side of the first table 121. A second sprocket 227 is positioned around the central axis stationary shaft 123 and aligned with the first spocket 226 and connected therewith by a first chain means 229. A first journal sleeve 230 freely rotates around the stationary shaft 123 and carries the first table 121 and the second sprocket 227 which are securely connected thereto. The rear face of the journal sleeve 230 rotatably carries a circular control element 328, a component of a strand movement timing mechanism 625 described hereinafter.

A drive mechanism third sprocket 238 and fourth sprocket 239 are carried on and coupled together by a journal bushing 240. The journal bushing 240 is rotatable around a post shaft extending from the front side of the first table 121. A fifth or "sun" sprocket 241 is aligned with the third sprocket 238 and positioned around the central axis stationary shaft 123 and coupled thereto by a sleeve 242. A second chain means 243 connects the sprockets 238 and 241. A sixth sprocket 244 is positioned around the central axis stationary shaft 123 and aligned with the fourth sprocket 239 and connected therewith by a third chain means 246. A second journal sleeve 247 freely rotates around the stationary shaft 123 and carries the second table 122 and the sixth sprocket 244 which are securely connected thereto. The journal sleeve 247 is secured around the stationary shaft 123 by a bearing nut 251.

The apparatus for control of moving strands from the contra-rotating set of strand carriers, 20R and 20F, is referred to generally by the numeral 325. The strand control apparatus 325 includes a set of mechanisms, indicated at 326, for guiding moving strands 24R from a set of rear bobbins 21R through an arc segment relative to the central axis of the braiding machine 120. The rear set of strands 24R pass through a set of peripheral and radially arcuate slots 327 in the first table 121 which are positioned between the guide mechanisms 326. The rear strands 24R are guided by the mechanisms 326, prior to movement into the arcuate slots 327, over an around moving strands 24F from a set of front bobbins 21F.

A control element 328 is adjustably positioned coaxially around the central axis stationary shaft 123 behind the rear side of the first table 121. The control element 328 carries and selectively positions a variable radius cam track 329 radially inwardly of the set of rear carriers 20R. The cam track 329 actuates and controls the set of strand guide mechanisms 326 during rotation of the first table 121. The cam track 329 has a set of alternating inner and outer portions, 329I and 329O, providing a "dwell" for the movement of the strand guiding mechanisms 326 at the radially outer and radially inner ends of the arcuate first table slots 327. The cam track dwell portions 329I and 329O are connected by a ramp or transition portion 329T.

A strand guiding mechanism 326 has a base plate 330 attached to the rear side of the first table 121, between any two of the radially arcuate slots 327, as by bolts 331. A base plate 330 carries a radially inner drive plate pin 332 and a radially outer swing arm pin 333 oriented parallel to the central axis of the braiding machine 120.

A strand guiding mechanism 326 also has a generally triangularly shaped drive plate indicated at 334. The drive plate base corner 335 is carried by the inner pin 332 and freely rotates on roller bearing assemblies 336. The drive plate apex corner 337 carries a rearwardly projecting cam follower 338 for confined engagement within the stationary cam track 329. The drive plate terminal corner 339 is connected to the base ends of dual connector means or links 340 by a pivot pin 341.

A strand guiding mechanism 326 further has an elongated rotatable swing arm indicated at 342. The swing arm base end 343 is carried by the pin 333 and freely rotates on roller bearing assemblies 344. The swing arm terminal end 345 carries an eyelet 346 for engaging a moving strand 24R from a rear bobbin 21R prior to movement thereof into a first table radially arcuate slot 327. The swing arm base end has an integral crank arm 347 connected to the terminal end of the dual connector links 340 by a pivot pin 348. The rear strands 24R are guided through an arc segment relative to the axis of the braiding machine 120, by movement of the swing arms 342 behind the first table 121, in a common plane perpendicular to the braiding machine axis during rotation of the first table 121.

The strand control apparatus 325 may further have a set of strand guide components positioned behind the rear side of the first table 121 and at a point along the axis of rotation for the swing arm 342 to receive a moving strand 24R from the rear bobbin 21R, before the moving strand 24R is engaged by the swing arm eyelet 346. As shown, the outer or base plate swing arm pin 333 has an extension 349 for mounting a strand guiding eyelet holder 350. The rearwardly projecting eyelet holder 350 establishes an optimum center point for a moving strand 24R from a rear bobbin 21R, irrespective of the actual point at which a strand 24R leaves a bobbin 21R. A centered rear strand 24R exits the eyelet holder 350 by a way of a side slot 351 and moved toward the swing arm terminal end 345. A set of eyelet holders 350 will establish and maintain an effective diameter of a set of moving strands 24R from a set of rear bobbins 21R coincident with the diameter of the axes of rotation of the front bobbins 21F.

A strand control apparatus 325 for a braiding machine 120 may have a stationary or rotating braiding ring, indicated at 353, positioned parallel to and in front of the set of front bobbins 21F and the second table 122. The braid ring 353 has an outer diameter coincident with the diameter of the axes of rotation of the front bobbins 21F, and with the effective diameter of a set of moving strands 24R from a set of rear bobbins 21R as established by the eyelet holders 350. All of the moving strands, 24R and 24F, are engaged with or bear upon the ring 353 prior to being pulled at the desired braid angle to the "work center" for tight braiding around a core or mandrel moving along the central axis of the braiding machine 120. As shown, a ring 353 is carried by a plurality of spoke shafts 354 extending outwardly from a hub 355 suitably secured to the central axis stationary shaft 123 forwardly of the second table 122.

The elements of a strand control apparatus, 325, numbered with in the sequence 326 through 355 are equivalent to like numbered elements disclosed in U.S. Pat. No. 4,535,674, 8/1985, Bull et al, Apparatus For Control Of Moving Strands From Rotating Strand Supply Bobbins.

Apparatus for mounting a set of front carriers 20F on the front side of the first table 121 and for driving the front carriers 20F by rotation of the second table 122, is referred to generally by the numeral 425. As shown, each carrier 20F is mounted for rotation around the central axis stationary shaft 123 on a shuttle indicated at 426. Each shuttle 426 has a forwardly facing platform 427 for mounting the base of a front carrier. Each shuttle platform 427 has a rearwardly projecting segment of an arcuate slide tang 428 terminating in an enlarged diameter keeper flange. A series of opposed inner and outer rollers 433 and 434, form a circular shuttle slide track. A shuttle platform 427 is secured in mounted position by positive engagement of a slide tang 428 and a keeper flange between and with the opposed slide roller series 433 and 434. A circular actuator cam track indicated at 435 is carried on the front side of the first table 121 radially inwardly of the opposed slide roller series 433 and 434. A set of shuttle drive assemblies, indicated at 437, is carried on the periphery of the rear side of the second table 122. Each drive assembly 437 includes a cam follower 444 for confined engagement with the actuator cam track 435.

The apparatus 425, for mounting and driving a set of front carriers 20F relative to moving strands from a set of contra-rotating rear carriers 20R, is disclosed, in U.S. Pat. No. 4,535,675, 8/1985, Bull et al, Apparatus For Rotating A Set Of Carriers For A Strand Supply Bobbin Relative To Moving Strands From A Set Of Contra-Rotating Carriers For A Strand Supply Bobbin. Reference is made to said patent for such further details as may be required to more fully understand the nature of the invention.

The mechanism for timing movement of strands 24R from a set of rear carriers 20R relative to a set of front carriers 20F, is referred to generally by the numeral 625. The mechanism 625 includes an adjustable control acutator means indicated at 626, carried by the frame member 127 and positioned radially of the central axis stationary shaft 123. The control actuator means 626 houses a rotatable control shaft 627. A first sprocket 628 is carried on the actuator control shaft 627. A journal sleeve, indicated at 629, is positioned around the central axis stationary shaft 123. A second sprocket 630 is aligned with the first sprocket 628 and positioned coaxially around the journal sleeve 629 and connected thereto. A first chain means 631 connects the first sprocket 628 with the second sprocket 630 so that incremental rotation of the actuator control shaft 627 will selectively position the second sprocket 628 and the journal sleeve 629 relative to the central axis stationary shaft 123. The braid control mechanism journal sleeve 629, operably fixed in position relative to the central axis stationary shaft 123, is carried by the journal sleeve 230 of the drive mechanism 225.

The control element 328 is positioned coaxially around the journal sleeve 629 and connected thereto. The variable radius cam track 329 of the strand control apparatus 325 is carried on the forward edge of the control element 328. The length and relative position of the alternating inner and outer portions 329I and 329O, of the cam track 329, relative to the distance between adjacent front carriers 20F, determines the braid ratio (e.g. 1 rear strand 24R: 2 front strands 24R). However, a fine and precise adjustment of the positions of the cam track 329 relative to the spacing between front carriers 20F will enable the user of the braiding machine 120 to compensate or allow for variation in strand movement attributable to wire friction induced by movement over the braiding ring 353 of the strand control apparatus 325.

Referring to FIG. 2, the adjustable control means 526 or 626 for the strand movement timing mechanism 525 or 625 has a sleeve tube 632 mounted on a frame member 127, as by a webbed bracket 633 and fastening bolts 634. The forward end of a bore 635 in the sleeve tube 632 has a bushing 636 for rotatable mounting of the forward end of a rotatable control shaft 527 or 627. The rearward end of the sleeve tube bore 635 opens into a larger bore 637 for seating of stationary ring collar 638, fixed as by a set screw 639.

The stationary ring collar 638 positions control shaft 527 or 627 coaxially of a known shaft phasing adjustment mechanism sold under the trademark INFINIT-INDEXER (TM Reg. No. 834,671) by Harmonic Drive Division, Emhart Machinery Group, 51 Amory Street, Wakefield, MA. 01880. This known adjustment mechanism includes an outer or "D" hub 640 connected to the rearward end of a control shaft 527 or 627. An inner or "S" hub 641 is carried by and connected to the stationary ring collar 638. The hubs 640 and 641 are housed within a knurled outer adjusting nut 642. The cooperative relation between the hubs 640 and 641 and the adjusting nut 642 is such that one revolution of the nut 642 results in a slight phase adjustment of the hub 640 and a control shaft 527 or 627.

The adjustable control means 526 or 626 for the strand movement timing mechanism 525 or 625, may have equivalent elements for selective and precise rotation of a control actuator shaft 527 or 627.

In a braiding machine of the design and construction disclosed in U.S. Pat. No. 3,756,117, rotation of the support plate 27 relative to the stationary sun gear 26 powers rotation of the base holders 33 for the inner set of spool holders 22B. Drive power is transmitted by the reaction of the teeth of the first or primary planet gear 29 with the teeth of the stationary sun gear 26. The teeth of the gear 29 react with the teeth of a second planet gear 30 axially coupled to a third planet gear 31. The teeth of the gear 31 react with a gear segment 34 carried on each base holder 33.

What is claimed is:

1. A mechanism for timing strand movement relative to rotation of outer and inner spool holders for outer and inner sets of strand supply spools being rotated in opposite directions by the drive mechanism of a braiding machine, said drive mechanism being mounted around a central axis stationary shaft extending laterally from a base supported frame member, said strand movement timing mechanism comprising:

an adjustable control actuator means carried by said frame member and positioned radially of said central axis stationary shaft and housing a rotatable control shaft;

a first sprocket carried on said actuator means control shaft;

a journal sleeve positioned around said central axis stationary shaft;

a second sprocket aligned with said first sprocket and positioned coaxially around said journal sleeve and connected thereto;

a first chain means connecting said first sprocket with said second sprocket whereby rotation of said actuator control shaft will rotate said second sprocket and said journal sleeve relative to said central axis stationary shaft;

a circular control element positioned coaxially around said journal sleeve and connected thereto and projecting radially of said central axis stationary shaft and terminating in an edge positioned adjacent said outer set of spool holders; and, a set of strand deflector cam plates positioned symmetrically around said control element edge and connected thereto and having contoured edge surfaces to guide the movement of strands from said set of outer spools relative to, over and under, moving strands from said set of inner spools.

2. A mechanism for timing strand movement relative to rotation of rear and front carriers for rear and front sets of strand supply bobbins being rotated in opposite directions by the drive mechanism of a braiding machine, said drive mechanism being mounted around a central axis stationary shaft extending laterally from a base supported frame member, said set of rear carriers being mounted on the rear side of a first table, the strands from said rear bobbins passing through a set of peripheral slots in said first table which are radially arcuate for movement of a set of strands from said rear bobbins through an arc segment relative to the axis of said stationary shaft, there being a second table in front of said first table, said set of front carriers being mounted on and driven around the front side of said first table by rotation of said second table, said central axis stationary shaft rotatably mounting said first and second tables thereon, said braiding machine further having a set of mechanisms carried on the rear side of said first table for guiding a set of strands from said rear bobbins prior to movement thereof into said first table radially arcuate peripheral slots and a variable radius cam track positioned behind the rear side of said first table and radially inwardly of said set of rear carriers, said cam track actuating and controlling said set of rear strand guide mechanisms by rotation of said first table, said strand movement timing mechanism comprising:

an adjustable control acutator means carried by said frame member and positioned radially of said central axis stationary shaft and housing a rotatable control shaft;

a first sprocket carried on said actuator means control shaft;

a journal sleeve positioned around said central axis stationary shaft;

a second sprocket aligned with said first sprocket and positioned coaxially around said journal sleeve and connected thereto;

a first chain means connecting said first sprocket with said second sprocket whereby rotation of said actuator control shaft will rotate said second sprocket and said journal sleeve relative to said central axis stationary shaft;

a circular control element positioned coaxially around said journal sleeve and connected thereto behind the rear side of said first table;

said variable radius cam track being carried and adjustably positioned by said circular control element.

3. In a braiding machine having sets of outer and inner holders for strand supply spools being rotated in opposite directions by a drive mechanism mounted around a central axis stationary shaft extending from a frame member, said drive mechanism being driven from a power input shaft extending from said frame member and including a stationary sun gear and a rotating table mounting said set of outer spool holders and rotatably carrying said set of inner spool holders, said machine having a journal sleeve (529) adjustably fixed in position around said stationary shaft, said drive mechanism further having:

a journal hub (540) rotatably mounted around said stationary shaft and carrying said journal sleeve;

a driven sprocket (548) positioned around said journal hub and connected thereto;

a drive sprocket (552) aligned with said third sprocket and carried on said power input shaft; and, a chain means (553) connecting said driven sprocket with said drive sprocket;

said rotating table being positioned around said journal hub and connected thereto so that rotation of said drive sprocket by said power input shaft will rotate said set of outer spool holders in one circular direction, and rotate said set of inner spool holders in the opposite direction.

4. In a braiding machine according to claim 3, a circular control element positioned around said journal sleeve and connected thereto and projecting radially of said stationary shaft and terminating in an edge postioned adjacent said outer set of spool holders, and, a set of strand deflector cam plates positioned symmetrically around said control element edge and connected thereto and having contoured edge surfaces to guide the movement of strands from said set of outer spools relative to, over and under, moving strands from said set of inner spools.

* * * * *

UNITED STATES PATENT AND TRADEMARK OFFICE

CERTIFICATE OF CORRECTION

PATENT NO. : 4,620,473

DATED : November 4, 1986

INVENTOR(S) : Jeffrey F. Bull

It is certified that error appears in the above-identified patent and that said Letters Patent are hereby corrected as shown below:

Col. 5, line 45 — change "rotatably" ~~to~~ — rotatable

Col. 8, line 62 — change "an around" to — and around

Signed and Sealed this

Third Day of November, 1987

*Attest:*

DONALD J. QUIGG

*Attesting Officer*

*Commissioner of Patents and Trademarks*